US006173857B1

(12) United States Patent
Olsson et al.

(10) Patent No.: US 6,173,857 B1
(45) Date of Patent: Jan. 16, 2001

(54) BOTTOM FOR A PACKAGE WITH INTERNAL OVERPRESSURE

(75) Inventors: Håkan Olsson; Anders Hilmersson, both of Lund (SE)

(73) Assignee: Tetra Laval Holdings & Finance, Pully (CH)

( * ) Notice: Under 35 U.S.C. 154(b), the term of this patent shall be extended for 0 days.

(21) Appl. No.: 09/051,671

(22) PCT Filed: Jan. 13, 1997

(86) PCT No.: PCT/SE97/00027

§ 371 Date: Oct. 28, 1998

§ 102(e) Date: Oct. 28, 1998

(87) PCT Pub. No.: WO97/26195

PCT Pub. Date: Jul. 24, 1997

(30) Foreign Application Priority Data

Jan. 15, 1996 (SE) ..... 9600115

(51) Int. Cl.[7] ..... B65D 7/42
(52) U.S. Cl. ..... 220/608; 220/612; 220/623
(58) Field of Search ..... 220/623, 624, 220/610, 608, 600, 612

(56) References Cited

U.S. PATENT DOCUMENTS

| | | | | |
|---|---|---|---|---|
| 163,747 | * | 5/1875 | Cummings | 220/623 X |
| 1,718,322 | * | 6/1929 | Walker | 220/612 |
| 2,197,437 | * | 4/1940 | McManus et al. | 220/612 |
| 3,693,828 | | 9/1972 | Kneusel et al. . | |
| 3,878,963 | * | 4/1975 | Knize | 220/623 |
| 4,023,700 | | 5/1977 | Buquet et al. . | |
| 4,363,404 | * | 12/1982 | Westphal | 220/624 X |
| 4,448,322 | * | 5/1984 | Kraska | 220/623 |
| 4,467,933 | * | 8/1984 | Wilkinson et al. | 220/623 |
| 4,606,472 | * | 8/1986 | Taube et al. | 220/600 X |
| 4,809,861 | * | 3/1989 | Wilkinson et al. | 220/623 |

FOREIGN PATENT DOCUMENTS

| | | |
|---|---|---|
| 0337500 | 9/1985 | (EP) . |
| 0482586 | 10/1991 | (EP) . |

* cited by examiner

*Primary Examiner*—Steven Pollard
(74) *Attorney, Agent, or Firm*—James Ray & Associates

(57) ABSTRACT

A three part package of polymer coated aluminum for fill-goods under pressure includes a for example frusto-conical barrel, a top and a bottom. The bottom includes a central, circular dome facing inwardly in the package, outside thereof a circular portion, which is inwardly curved and extends toward the barrel, and a rim, which extends downwardly from the curved portion and is intended for sealing to the barrel.

2 Claims, 2 Drawing Sheets

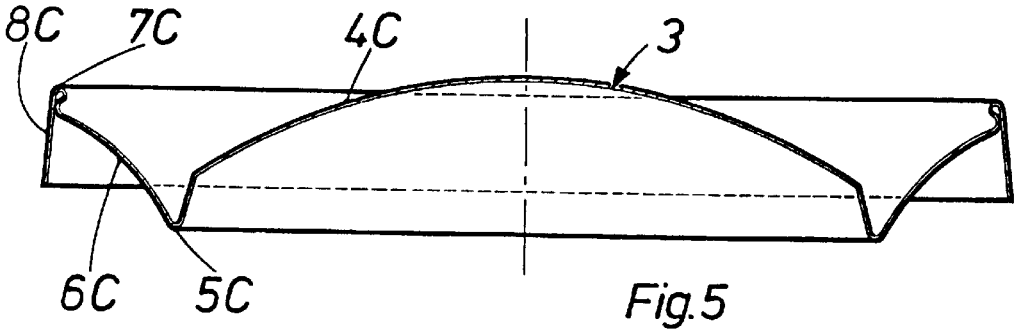
Fig.5
Fig.6
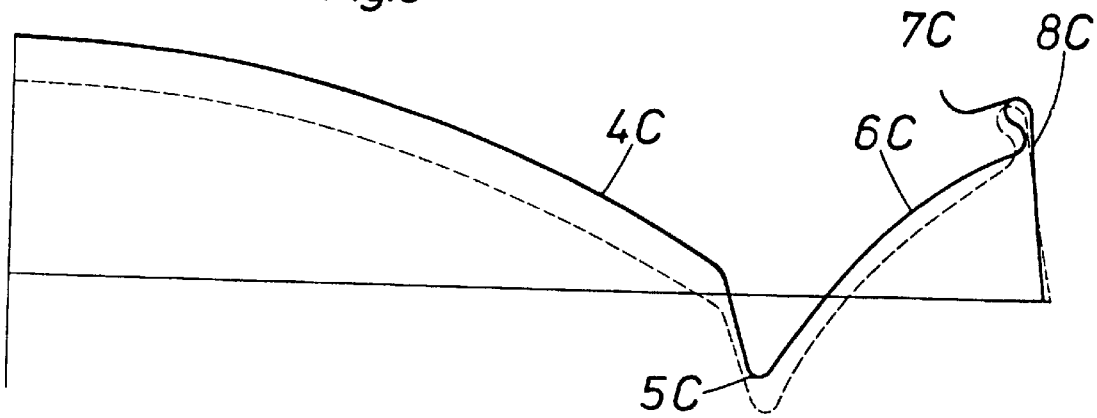

BOTTOM FOR A PACKAGE WITH INTERNAL OVERPRESSURE

TECHNICAL FIELD

The present invention relates to a bottom for a three part package, preferably of polymer coated aluminum, for fill goods under pressure, including a barrel, which preferably can be frusto-conical or cylindrical, a top or a cover and a bottom.

BACKGROUND OF THE INVENTION

A typical example of a traditional three part package is a tin can, which is soldered and/or folded together of plate. The ordinary can is cylindrical and is thus manufactured of a rolled rectangular barrel, a circular cover and a circular bottom. A tin can is normally not exposed to any substantial internal overpressure, which means that the cover and the bottom can be generally planar.

A bottom design for a cylindrical package is shown in U.S. Pat. No. 4,023,700. This design enables the package to be exposed for an internal overpressure. The material in the package is thin aluminium, which at least internally is coated with polyethylene type HD, which enables a sealing. The bottom has a dome, which faces downward and whose circular outer edge is folded to a rim, which by heating can be melt connected to the cylindrical barrel of the package. For preventing the internal overpressure from creating a force for splitting up the package between the barrel and the bottom the space around the dome at its outside against the barrel is filled with thermoplastic foam. A further reinforcement can be accomplished by means of an adhesive band around the package on its outside.

It goes without saying that such a design leads to high material and manufacturing costs and adds to the weight of the package, which is an important negative factor.

THE INVENTION

The object of the invention is to accomplish a bottom of the kind described above, which does not suffer from the drawbacks mentioned above.

This is according to the invention attained in that the bottom comprises the following main parts: a central, circular dome facing inwardly in the package, outside thereof a circular portion, which is inwardly curved and extends towards the barrel, and a rim, which extends downwardly from the curved portion and is intended for sealing to the barrel.

A further drawback with the design according to U.S. Pat. No. 4,023,700 mentioned above is that the package will stand on the lower edge of the barrel, which may be uneven and have a sharp edge and for that reason can need treatment for becoming more suitable for this purpose.

This drawback can be obviated at a bottom according to the invention in that a circular bead between the dome and the curved portion is arranged at a lower level than the rim and thus the barrel after the sealing thereto, so that the package will stand on the bead.

For preventing to a certain extent splitting forces from the curved portion from reaching the rim a connection therebetween may be formed as a rounded edge, which in section is generally semi-circular.

An even better result in this respect is accomplished, if this connection is double curved, i e the generally semi-circular edge is supplemented at its inside with a curve, which for example may be press rolled.

A transition portion from the dome to the circular bead may be generally vertical, but a better result with regard to decreasing the split risk between the rim and the barrel is obtained in that this transition portion is slanted outwardly with an angle of for example 15° with the vertical.

BRIEF DESCRIPTION OF THE DRAWINGS

The invention will be further described below under reference to the accompanying drawings, in which FIGS. 3–5 are sections (to greater scales than FIG. 2) through three embodiments or development stages of a bottom according to the invention, and FIG. 6 to a greater scale illustrates the effects of an exposure of a bottom according to FIG. 5 to an internal overpressure.

DESCRIPTION OF PREFERRED EMBODIMENTS

Figure 1:
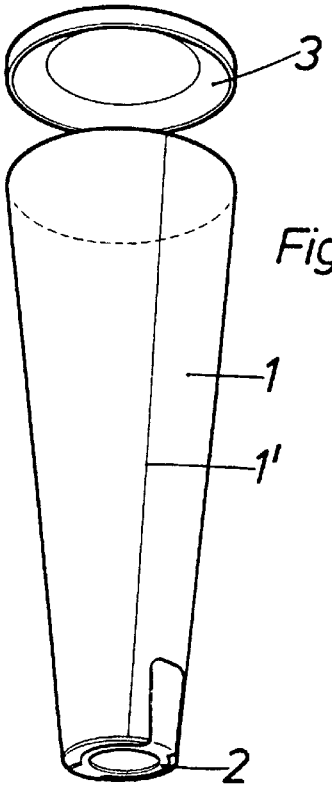
FIG. 1 is a perspective side view of a drink package turned upside down and under manufacture, FIG. 2 to a greater scale than FIG. 1 in a side view and partly in section shows a lower part of the drink package with a bottom according to the invention.

A partly completed package for fill goods under pressure, namely preferably for beverages under pressure, for example carbonated soft drinks or beer, is shown upside down in FIG. 1. It can have a frusto-conical shape and includes a barrel 1, a top 2 and a bottom 3, which means that it is a three part package of the same type as for example a tin can. The package in its entirety is preferably manufactured of aluminium plate, which is provided with a polymer coating, that enables a sealing by means of induction heat.

The barrel 1 is manufactured from a plane blank and is after forming to the shown shape provided with a longitudinal sealing 1'.

The top 2 is preferably manufactured by means of deep drawing and can—as appears from FIG. 1—be provided with a so called pull tab for opening of the package.

The bottom 3, which is the object of the invention and accordingly will be described further below, can be manufactured by hard aluminium and be deep drawn to optimal shape and minimal weight. The thickness can be about 220 $\mu$m or more generally be in the interval 200–300 $\mu$m. FIG. 1 illustrates the position before the bottom is united with the remainder of the package, i e at a stage when the contents is filled. The sealing is performed inductively in a manner not further described here. Also other sealings of the package can be performed inductively.

Figure 2:
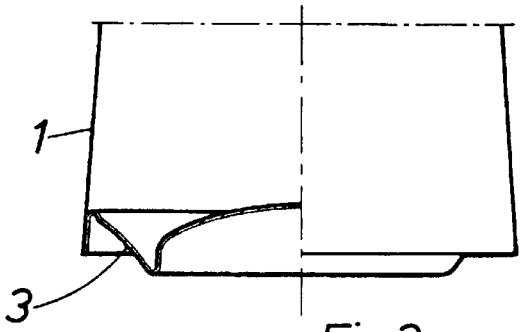

In FIG. 2, where the package is correctly positioned, the bottom 3 and the lower part of the barrel 1 are shown. It appears here that the bottom 3 has such a form that the package stands on a part of the bottom and that the possibly sharp edged connection between the barrel and the bottom does not contact the foundation and accordingly can not damage it.

Figure 3:
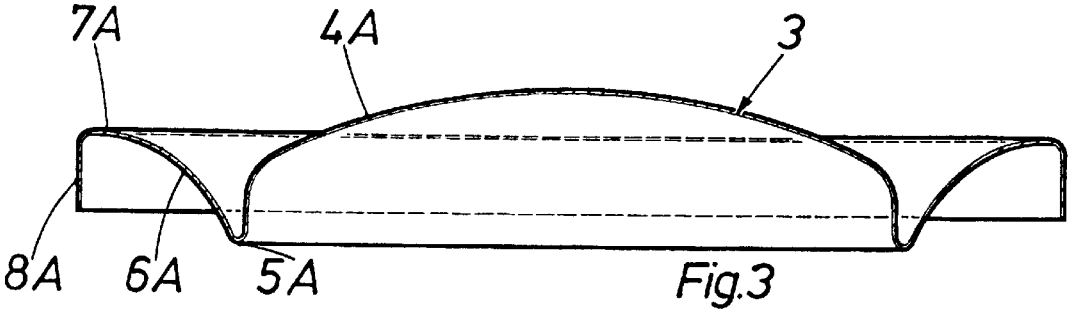
Figure 4:
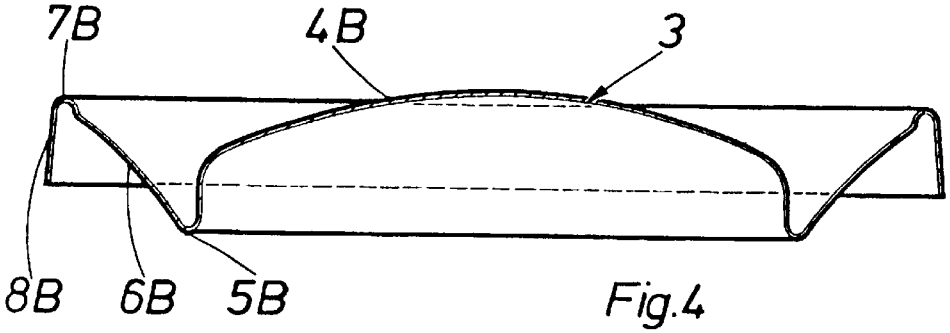

The shape of the bottom 3 appears most clearly in FIGS. 3–5, which show three examples, of which the one according to FIG. 5 presently is preferred.

The bottom according to FIG. 3 has a central, circular dome 4A, which faces inwardly in the package and passes over downwardly into a circular bead 5A. From there a circular portion 6A, which is inwardly curved, extends to the connection of the bottom to the barrel 1 at 7A; vide FIG. 2. From the connection 7A a rim 8A extends downwardly. The inclination of this rim 8A generally corresponds to the inclination of the barrel 1 at a frusto-conical package, and the rim 8A is intended for sealing of the bottom 3 by means of induction heat to the barrel 1 in an overlapping joint.

By this design the advantage among others is obtained that the outer surface of the rim 8A, which shall be sealed to the barrel and for that reason has to be coated with a sealable polymer, passes over in the surface of the bottom which is facing inwardly to the content of the package. The aluminum material of the bottom 3 thus only need be polymer covered on one of its surfaces.

The proportion between the outer diameter of the bottom 3 and the diameter of the dome 4A or the bead 5A is so chosen that the deformation under an internal overpressure in the package is distributed in a suitable way between the dome 4A and the circular, curved portion 6A, a decisive factor being that a minimal pulling or slitting force shall be transferred to the rim 8A. The radius at the bead 5A is as small as possible for obtaining an increased strength. A design as described above allows a minimal material thickness.

At a dimensioning chosen as an example in a practical case the outer diameter of the bottom 3 was 64 mm and the diameter of the bead 5A 43 mm. The curve radius of the dome 4A was 45 mm and its height from the bead 5A to its top 10 mm. The radius in the curved portion 6A was 9 mm and the height of the rim 8A 5 mm. The inner curve radius of the bead 5A was 0.5 mm.

When a package of the kind shown in FIG. 1 is exposed to an internal overpressure, for example from beer or carbonated soft drink or another fill goods under pressure, the above mentioned requirement on a suitable distribution of the deformation between the dome 4A and the curved portion 6A is fulfilled.

At very high pressures slitting or inwardly directed forces can in this embodiment, however, be introduced in the rim 8A, which tends to losen its sealing to the barrel 1. For obviating this tendency it is possible as a development step to use an embodiment according to FIG. 4.

In this figure corresponding parts as in FIG. 3 have the same reference numerals with the addition of the letter B instead of A, so that the dome 4B, the bead 5B, the curved portion 6B, the connection 7B and the rim 8B are to be found in FIG. 4.

The main differences in relation to the embodiment according to FIG. 3 is in the design of the curved portion 6B and the connection 7B to the rim 8B. The curved portion 6B is here shallower. The connection 7B is designed as a rounded edge, which in section is generally semi-circular, which means that the transfer of slitting forces to the rim 8B is decreased. Hereby the risk for breaking of the sealing to the barrel 1 is decreased. The package is generally speaking more sensitive for slitting forces than shear forces.

In a practical example the bottom 3 may have the following dimensions: outer diameter 64 mm, diameter of the bead 5B or the dome 4B 43 mm, radius of the dome 4B 45 mm and height 10 mm, radius of the curved portion 6B 25 mm, radius of the connection 7B 0.65 mm and height of the rim 8B 5 mm.

A further improved embodiment of the bottom 3 according to FIG. 5 is presently preferred. The reference numerals have here the addition of the letter C, and accordingly the dome 4C, the bead 5C, the curved portion 6C, the connection 7C and the rim 8C can be found.

The embodiment according to FIG. 5 differs from that according to FIG. 4 above all in two respects, namely in the transition from the dome 4C to the bead SC and the design of the connection 7C.

In the embodiment according to FIG. 4 (as well as that according to FIG. 3) the transition from the dome 4B to the bead 5B is thus generally vertical, whereas in the embodiment according to FIG. 5 it is slightly outwardly inclined, for example with an angle of 15° with the vertical. The connection 7C is further double-curved in the way which appears from FIG. 5. A bottom 3 with such a double-curved connection 7C can be manufactured by deep drawing—an operation which is sufficient for manufacturing the embodiments according to FIGS. 3 and 4—followed by a press rolling for accomplishing the inner curve.

A bottom 3 according to FIG. 5 can in a practical case have the following dimensions: outer diameter of the bottom 3 65 mm, diameter of the bead 5 47 mm, height of the dome 4C 10 mm and curve radius 40 mm, radius of the bead 5C 0.3 mm. radius of the curved portion 6C 15 mm, radii of the connection 7C 0.3 and 0.4 mm, respectively, and height of the rim 8C 6 mm.

FIG. 6 illustrates how a bottom 3 in accordance with the embodiment shown in FIG. 5 behaves under the influence of an internal overpressure (in a package of the type shown in FIG. 1). Half a bottom is thus illustrated in FIG. 6, the right end in the figure being regarded as free and unconstricted. The free appearance of the bottom is shown with a full line, i e when the bottom is not exposed to any overpressure. The appearance of the bottom, when it is exposed to an inner overpressure, is shown with a dashed line. It appears that the deformation is comparatively evenly distributed over the entire bottom starting from the double-curved connection 7C between the curved portion 6C and the rim 8C. It is even more important that the rim 8C is not exposed to any substantial slitting force and thus that there is no risk for slitting the sealing to the barrel 1 (FIGS. 1 and 2), when the package is exposed to the internal overpressure up to the limit for which the package is intended.

What is claimed is:

1. A bottom for a three part package, preferably of polymer coated aluminum, for fill goods under pressure, said three part package including a barrel, a top and said bottom, which comprise the following main parts:

a central, circular dome facing inwardly in the package, a circular portion outside thereof defining an inwardly curved portion which extends towards the barrel, a rim which extends downwardly from the curved portion and is intended for sealing to the barrel and a connection between the curved portion and the rim formed as a edge, and a circular bead between the dome and said curved portion having a lower edge horizontally disposed at a lower level than the rim to permit the package to stand on said bead.

2. A bottom for a three part package, preferably of polymer coated aluminum, for fill goods under pressure, said three part Package including a barrel, a top and said bottom, which comprise the following main parts:

a central, circular dome facing inwardly in the package, a circular portion outside thereof defining an inwardly curved portion which extends towards the barrel, a rim which extends downwardly from the curved portion and is intended for sealing to the barrel and a connection between the curved portion and the rim formed as an edge, and wherein said connection comprises a generally semi-circular edge, supplemented at its inside with a curve.

* * * * *